United States Patent [19]

Chipp et al.

[11] Patent Number: 4,970,885

[45] Date of Patent: Nov. 20, 1990

[54] TUBE BENDING APPARATUS

[75] Inventors: Ronald E. Chipp, Oak Park; Paul M. Smith, Madison Heights, both of Mich.

[73] Assignee: Vickers, Incorporated, Troy, Mich.

[21] Appl. No.: 364,869

[22] Filed: Jun. 12, 1989

[51] Int. Cl.[5] ..... B21D 7/04; B21D 7/12

[52] U.S. Cl. ..... 72/8; 72/151

[58] Field of Search ..... 72/8, 9, 11, 12, 149, 72/150, 151, 155

[56] References Cited

U.S. PATENT DOCUMENTS

| | | | |
|---|---|---|---|
| 2,988,127 | 6/1961 | Gray | 72/151 X |
| 3,545,242 | 12/1970 | Dean | 72/151 |
| 3,899,908 | 8/1975 | Somov et al. | 72/28 |
| 4,006,621 | 2/1977 | Moshnin et al. | 72/151 |
| 4,269,054 | 5/1981 | Eaton | 72/151 |
| 4,380,917 | 4/1983 | Uchida et al. | 72/8 |
| 4,747,283 | 5/1988 | Moore et al. | 72/8 |
| 4,893,391 | 1/1990 | Zobel et al. | 72/151 X |

FOREIGN PATENT DOCUMENTS

| | | | |
|---|---|---|---|
| 51-1356 | 1/1976 | Japan | 72/151 |
| 58-128224 | 7/1983 | Japan | 72/151 |
| 60-137524 | 7/1985 | Japan | 72/151 |
| 543447 | 4/1977 | U.S.S.R. | 72/151 |

*Primary Examiner*—E. Michael Combs

*Attorney, Agent, or Firm*—Barnes, Kisselle, Raisch, Choate, Whittemore & Hulbert

[57] ABSTRACT

An electrohydraulic system for bending tube stock includes a bend head having a mandrel and an actuator coupled to a bending die for engaging the tube stock and bending the stock around the mandrel. A clamp is coupled to a second actuator for gripping the tube stock, and a third actuator mechanism in the form of a boost cylinder is coupled to the clamp for urging the tube stock lengthwise into the bend head. An electrohydraulic valve is responsive to an electronic valve control signal for variably feeding hydraulic fluid to the boost cylinder, and velocity of slip at the clamp is determined. An input pressure command signal is compared with pressure at the boost cylinder to develop a pressure error signal. Slip velocity is compared with a velocity limit command to develop a velocity difference when slip velocity exceeds the velocity limit, and the pressure error signal is modulated and employed as the valve command signal to maintain slip velocity at or below the level of the velocity limit command.

8 Claims, 3 Drawing Sheets

TUBE BENDING APPARATUS

The present invention is directed to control of electrohydraulic actuator systems, and more particularly to control of a tube stock bending machine to prevent thinning of the tube wall during the bending operation.

BACKGROUND AND OBJECTS OF THE INVENTION

There are numerous applications in the electrohydraulic control field in which it is desired to control motion and/or pressure at an actuator system and load. In a typical machine for bending tube stock, for example, a bending head includes a mandrel and an actuated die for bending tube stock around the mandrel. During the bending operation, the tube stock is clamped or gripped upstream of the bending head, and is urged toward the bending head during the bending operation to prevent thinning of the tube wall. The clamp is allowed to slip lengthwise of the tube stock, but it is desirable to push the stock into the bending head with pressure that is precisely controlled as a function of motion of the bend actuator and die.

In tube bending machines of the described character, pressure applied by a boost actuator to the tube clamp has been measured, and a pressure relief valve has been modulated to obtain a desired profile of pressure versus time. However, it has not heretofore been attempted to control velocity of slip of the clamping mechanism along the tube stock, or to control lengthwise pressure applied to the tube stock as a function of such velocity. Consequently, control systems heretofore proposed have not obtained desired quality control of the bending operation, particularly as applied to thinning of the tube wall during bending.

It is therefore a general object of the present invention to provide an electrohydraulic actuator system that obtains enhanced and precise control of both pressure and motion at the actuator and load. Another object of the present invention is to provide a system of the described character that embodies state-of-the-art electronic control capability, and yet is easy and economical to implement both in new system construction and in retrofit of existing systems.

Another and more specific object of the present invention is to provide an electrohydraulic system for controlling pressure and velocity at an actuator load, such as at the boost cylinder of a tube bending machine, at a precise programmable function. A related object of the invention is to provide an electrohydraulic system for bending tube stock that features enhanced control of the boost cylinder for urging the tube stock lengthwise into the bend head to reduce thinning during the bending operation.

SUMMARY OF THE INVENTION

An electrohydraulic system for controlling pressure applied to a movable load coupled to a hydraulic actuator, in accordance with a first important aspect of the present invention, includes an electrohydraulic valve responsive to an electronic valve control signal for variably feeding hydraulic fluid under pressure to the actuator. A sensor provides a pressure feedback signal as a function of hydraulic fluid pressure at the actuator, and a second sensor provides a velocity feedback signal as a function of velocity at the load coupled to the actuator. A pressure error signal is obtained as a function of a difference between the pressure feedback signal and a pressure command signal received as an input to the control system. The pressure error signal is modulated as a function of the velocity feedback signal to provide the valve control signal to the valve. Specifically, in a preferred embodiment of the invention, the velocity feedback signal is compared to a velocity limit command signal input to the system to develop a velocity difference signal when the velocity feedback signal exceeds the limit command signal, and the pressure error signal is modulated as a function of the velocity difference signal to maintain velocity at the actuator and load at a level not greater than that associated with the velocity limit command input.

An electrohydraulic system for bending tube stock, in accordance with a second important aspect and presently preferred implementation of the invention, includes a bend head having a mandrel and an actuator coupled to a bending die for engaging the tube stock and bending the stock around the mandrel. A clamp is coupled to a second actuator for gripping the tube stock, and a third actuator mechanism in the form of a boost cylinder is coupled to the clamp for urging the tube stock lengthwise into the bend head. An electrohydraulic valve is responsive to an electronic valve control signal for variably feeding hydraulic fluid to the boost cylinder, and velocity of slip at the clamp is determined. An input command signal is modulated as function of such slip velocity to develop the valve control signal applied to the valve. In the preferred implementation of the invention, slip velocity is compared with a velocity limit command to develop a velocity difference when slip velocity exceeds the velocity limit, and the input command signal is modulated to maintain slip velocity at or below the level of the velocity limit command.

In the preferred implementation of the invention, the input command takes the form of a pressure command for controlling pressure applied to the tube stock into the bend head. A second feedback control loop, in addition to the velocity feedback control loop previously described, includes a pressure sensor for measuring hydraulic pressure applied to the boost actuator cylinder. Measured pressure is compared with the pressure command, and the valve control signal is developed as a function of a difference between the command and measured pressures. The resulting pressure error is employed to develop the valve control signals and modulated by the velocity control loop only when slip velocity at the tube clamp exceeds the velocity limit command.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENT

Figure 1:
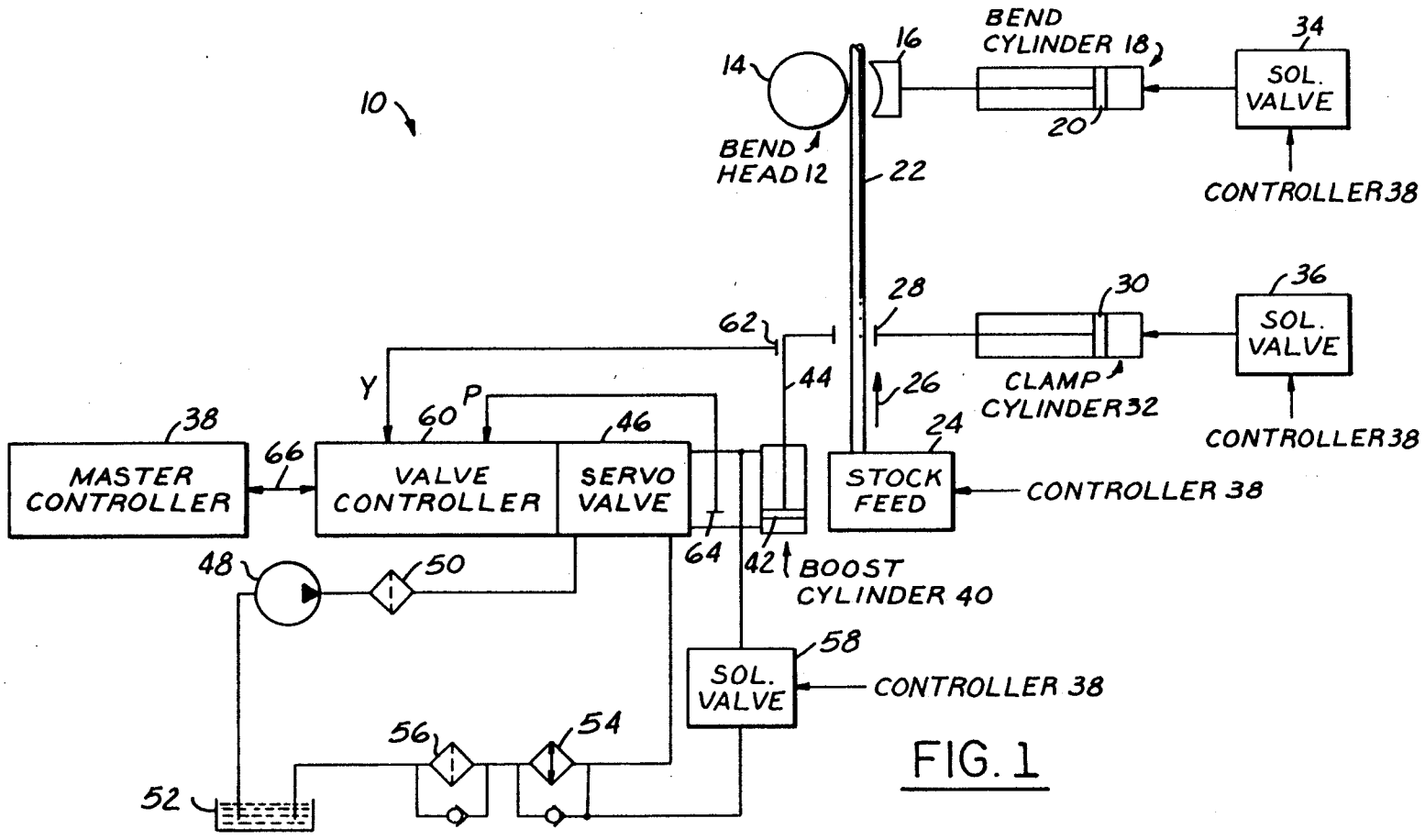
FIG. 1 is a functional block diagram of a tube bending machine and associated control system in accordance with a presently preferred implementation of the invention.

FIG. 1 illustrates a tube stock bending machine 10 in accordance with a presently preferred embodiment of the invention. A bend head 12 includes a mandrel 14 and a die 16 coupled to the piston 20 of a bend actuator or cylinder 18. Tube stock 22 is fed by an intermittent drive 24 in the direction 26 between mandrel 14 and die 16. A clamping mechanism 28 is positioned upstream of bend head 12 with respect to direction 26 of tube stock motion, and is coupled to the piston 30 of a clamp actuator or cylinder 32 for selectively gripping the tube stock. Bend cylinder 18 and clamp cylinder 32 are coupled to associated solenoid valves 34, 36 for selectively feeding hydraulic fluid under pressure to the respective cylinders. Solenoid valves 34, 36 and stock feed mechanism 24 are connected to a master controller 38 for coordinating operation, as will be described hereinafter.

A boost actuator or cylinder 40 includes a piston 42 having a rod 44 coupled to clamp mechanism 28, and suitable ports for receiving hydraulic fluid under pressure on opposed sides of piston 42. The fluid ports of cylinder 40 are connected to a servo valve 46 that supplies fluid to cylinder 40 from a pump 48 through a filter 50, and returns fluid from cylinder 40 to a sump 52 through a chiller 54 and a filter 56. A solenoid valve 58 is connected between the rod side of cylinder 40 and the return port of servo valve 46, and receives electrical control signals from controller 38 for selectively dumping rod-side cylinder pressure to reservoir 52. A valve controller 60 supplies valve control signals to the torque motor of servo valve 46. An electroacoustic sensor 62 or other suitable sensor is mounted on cylinder 40 and supplies a signal Y to valve controller 60 indicative of position of piston 42 within cylinder 40. A pressure sensor 64 is responsive to drive pressure of hydraulic fluid on the rod-remote side of boost cylinder 40 for supplying to controller 60 a corresponding signal P indicative of fluid pressure. Valve controller 60 is connected to master controller 38, preferably by a high-speed bidirectional serial data bus 66, for supplying input command signals to the valve controller and receiving signals from the valve controller indicative of system operation.

Figure 2:
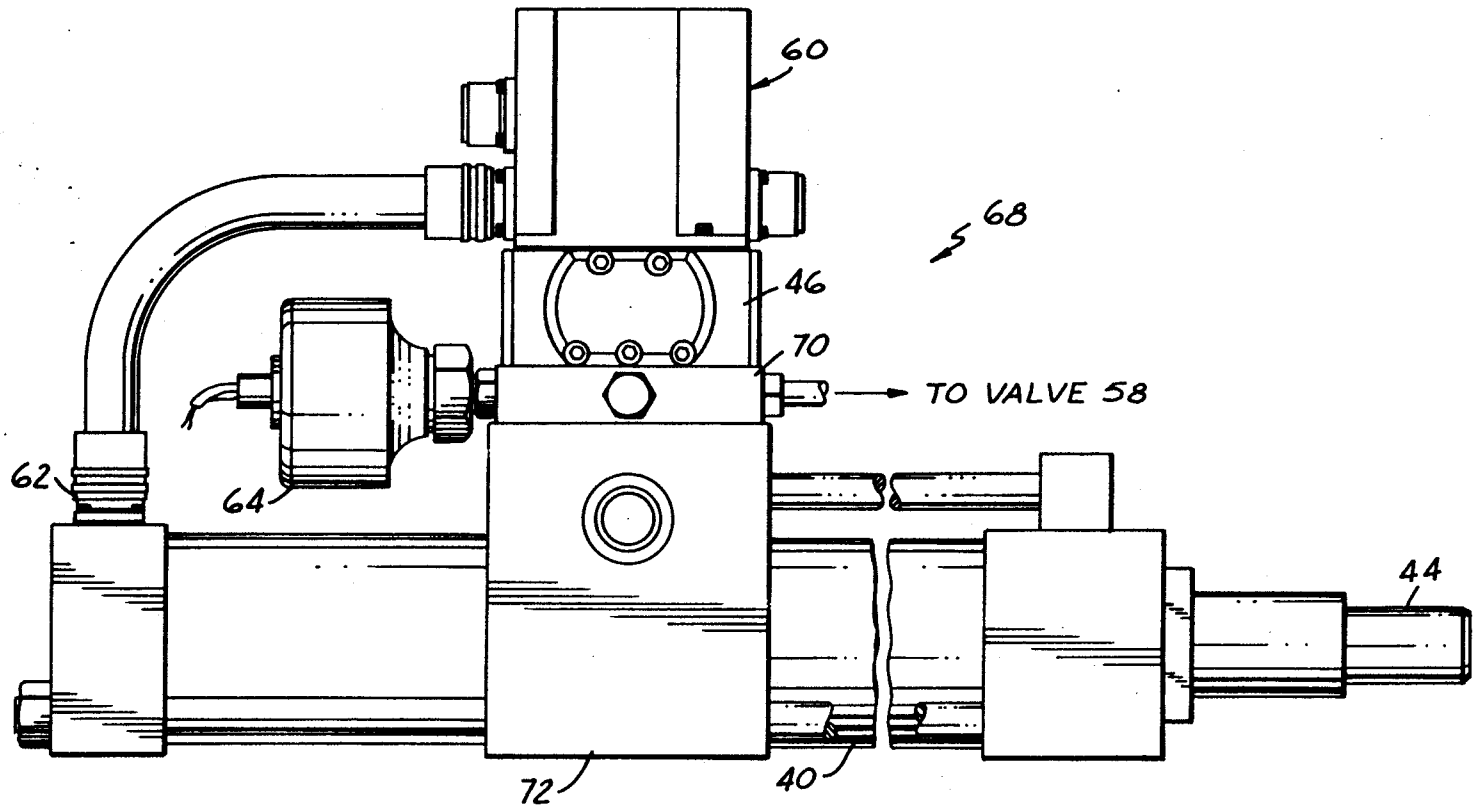
FIG. 2 is a side elevational view of the boost cylinder, valve and valve controller assembly illustrated functionally in FIG. 1.

Boost cylinder 40, servo valve 46, valve controller 60, acoustic sensor 62 and pressure sensor 64 preferably take the form of a unitary assembly 68 illustrated in FIG. 2. Servo valve 46 is mounted by a tap plate 70 to the manifold housing 72 of boost cylinder 40. Tap plate 70 provides for connection of pressure sensor 64 to the fluid passage between servo valve 46 and the rod-remote port of cylinder 40. Valve controller 60 is mounted on servo valve 46, and has multipleconnecters for connection to master controller 38 (FIG. 1), pressure sensor 64 and electroacoustic sensor 62. U.S. Pat. No. 4,757,747 discloses controller 60, servo valve 46, actuator 40 and sensor 62 in a unitary assembly that includes microprocessor-based control electronics for providing control signals to the torque motor of valve 46. The control electronics disclosed in such patent also includes facility for actuating electroacoustic sensor 62 and receiving therefrom signals Y indicative of actuator piston position. U.S. Pat. No. 4,811,561 discloses an electrohydraulic system that includes actuators with associated servo valves and controllers coupled to a master controller by a high-speed bidirectional serial communication and control bus 66 (FIG. 1). The disclosures of such U.S. Patents, both assigned to the assignee hereof, are incorporated here in by reference.

In general operation, stock feed mechanism 24 is actuated to feed a predetermined length of stock 22 between mandrel 14 and die 16. Stock motion is then arrested, and cylinder 32 is actuated to clamp the stock. Bend cylinder 18 is then actuated to bend stock 22 around mandrel 14. At the same time, boost cylinder 40 is actuated to urge stock 22 in the direction 26 toward bend head 12. Clamp 28 is allowed to slip along stock 22 as long as pressure is maintained. Such pressure into the bend head, when properly controlled, helps reduce thinning of the tube stock wall during the bending operation.

Figure 3:
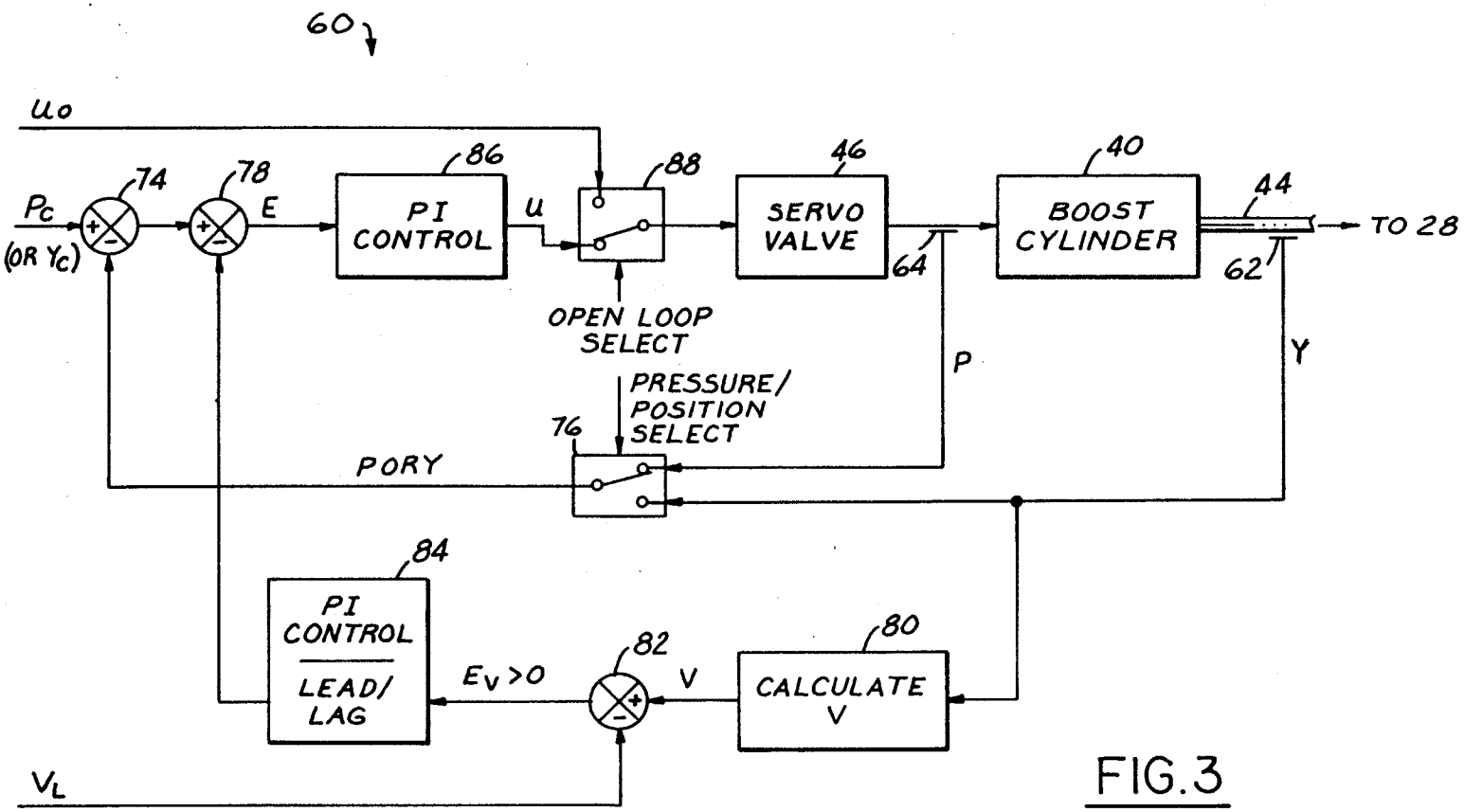
FIG. 3 is a functional block diagram of the valve controller in FIG. 1.

FIG. 3 is a functional block diagram of valve controller 60, coupled to servo valve 46 and boost cylinder 40, configured by suitable programming in a presently preferred mode of controller operation. A comparator 74 receives an input pressure command signal Pc from master controller 38 (FIG. 1) in a pressure control mode of operation, or an input position command signal Yc in a position control mode of operation. Pressure feedback signal P from sensor 64 and position feedback signal Y from sensor 62 are fed to a switch 76 that receives a pressure/position mode selection input (from the master controller), and provides a selected sensor signal output to the second input of comparator 74. The output of comparator 74, indicative of either a pressure error or position error in the selected mode of operation, is fed to one input of a second comparator 76. Slip velocity V at boost cylinder 40 is calculated at 80 based upon cylinder position sensor signal Y, and such velocity is compared at 82 with a velocity limit command signal Vl from master controller 38. When the slip velocity at boost cylinder 40 exceeds the velocity limit command, a velocity error signal Ev is fed to the second input of comparator 78 through a proportional/integral control and lead/lag compensation network 84.

Comparator 78 provides an error signal E to a proportional/integral control network 86, which in turn provides a corresponding valve control signal U to one signal input of an electronic switch 88. The other signal input of switch 88 receives a valve command signal Uo directly from master controller 38 (FIG. 1), and switch 88 is controlled by an open/closed loop mode selection input from the master controller. The output of switch 88 is fed as a pulse width modulated valve control signal to the torque motor of servo valve 46.

In operation, switch 88 is normally configured for closed-loop control (as shown) where command U is fed to servo valve 46, and switch 76 is normally configured for pressure signal feedback as illustrated in FIG. 3. Pressure command Pc is compared with actual pressure P at boost cylinder 40, and a pressure error signal is generated at comparator 74. As long as slip velocity at boost cylinder 44 remains below the level corresponding to velocity limit command Vl, the pressure error output of comparator 74 is fed by comparator 78 to control network 86. However, if the slip velocity at boost cylinder 40 exceeds the level of limit command Vl, the pressure error output of comparator 74 is correspondingly reduced by velocity error Ev to modulate command U to servo valve 46 and reduce hydraulic fluid flow to a level that maintains the slip velocity at or below the desired limit. It will be appreciated that the profile of pressure command Pc versus time, and velocity limit command Vl, are selected in coordination with operation at bend head 12 to obtain bends of optimum quality. Such selection and tailoring are normally done empirically. Facility for selectable position-control and open-loop modes of operation are provide primarily for maintenance and calibration purposes.

We claim:

1. An electrohydraulic system for bending tube stock that includes a bend head with a mandrel and means for engaging the tube stock and bending the stock around the mandrel, and means to reduce thinning of the tube stock during bending around the mandrel comprising:

means for gripping the tube stock, hydraulic actuator means coupled to said gripping means for urging the tube stock lengthwise into said bend head, and control means coupled to said stock-urging means for controlling urging of the stock into said bend head, said control means comprising electrohydraulic valve means responsive to an electronic valve control signal for variably feeding hydraulic fluid under pressure to said actuator means, means for receiving an electronic input command signal, means coupled to said stock-urging means for determining velocity of slip of said stock-gripping means relative to the stock, and means responsive to said determined slip velocity for modulating application of said input command signal to said valve as said valve control signal for varying the fluid pressure applied to said actuator means.

2. The system set forth in claim 1 wherein said velocitydetermining means comprises means for providing an electronic velocity signal as a function of said velocity of slip, and wherein said modulating means comprises means for providing said valve control signal as a function of a difference between said input command signal and said velocity signal.

3. The system set forth in claim 2 wherein said modulating means comprises means for receiving a velocity limit command signal, means for comparing said velocity signal to said velocity limit command signal to develop a velocity difference signal when said velocity signal exceeds said velocity limit command signal, and means for modulating said input command signal as a function of said velocity difference signal.

4. The system set forth in claim 2 further comprising means for measuring a selected control variable at said actuator means and providing a corresponding electronic control-variable feedback signal; and wherein said means for receiving said input command signal comprises means for receiving a command signal for control of said selected control variable, and means for providing said valve control signal as a function of a difference between said selected-variable command signal and said control-variable feedback signal.

5. The system set forth in claim 4 wherein said control variable comprises position at said actuator means.

6. The system set forth in claim 4 wherein said control variable comprises pressure at said actuator means.

7. The system set forth in claim 4 wherein said variablemeasuring means comprises first and second sensors at said actuator means for providing respective feedback signals as functions of position and said fluid pressure at said actuator means, and means for selecting between said feedback signals for connection to said input command signal-receiving means.

8. The system set forth in claim 1 wherein said actuator means comprises a linear actuator having a piston slidable within a cylinder, a rod coupling said piston to said gripping means, ports for feeding hydraulic fluid from said valve means to said cylinder on opposed side of said piston, and second valve means coupled to the said port on the rod side of said piston for dumping fluid pressure on said rod side of said piston during application of fluid pressure on the opposing side of said piston.

* * * * *